US011305338B2

(12) United States Patent
Naclerio et al.

(10) Patent No.: US 11,305,338 B2
(45) Date of Patent: Apr. 19, 2022

(54) METHOD FOR MANUFACTURING A CRYSTALLIZER FOR CONTINUOUS CASTING

(71) Applicant: EM MOULDS S.P.A. A SOCIO UNICO, Florence (IT)

(72) Inventors: Angelo Naclerio, Florence (IT); Giovanni Mori, Florence (IT)

(73) Assignee: EM MOULDS S.P.A. A SOCIO UNICO, Florence (IT)

( * ) Notice: Subject to any disclaimer, the term of this patent is extended or adjusted under 35 U.S.C. 154(b) by 0 days.

(21) Appl. No.: 16/492,544

(22) PCT Filed: Mar. 9, 2018

(86) PCT No.: PCT/IB2018/051564

§ 371 (c)(1),
(2) Date: Sep. 9, 2019

(87) PCT Pub. No.: WO2018/163125

PCT Pub. Date: Sep. 13, 2018

(65) Prior Publication Data

US 2020/0171564 A1 Jun. 4, 2020

(30) Foreign Application Priority Data

Mar. 10, 2017 (IT) ..... 102017000027045

(51) Int. Cl.

| | |
|---|---|
| ***B22D 11/055*** | (2006.01) |
| ***B22D 11/041*** | (2006.01) |
| ***B22D 11/043*** | (2006.01) |
| ***B22D 11/057*** | (2006.01) |
| ***B22D 11/059*** | (2006.01) |
| ***B22D 11/22*** | (2006.01) |

(52) U.S. Cl.

CPC ..... *B22D 11/055* (2013.01); *B22D 11/041* (2013.01); *B22D 11/043* (2013.01);
(Continued)

(58) Field of Classification Search

CPC ... B22D 11/055; B22D 11/057; B22D 11/059; B21C 1/22–26

See application file for complete search history.

(56) References Cited

U.S. PATENT DOCUMENTS 5,407,499 A * 4/1995 Gravemann ..... B22D 11/057 148/411
2003/0094209 A1* 5/2003 Imasaki ..... B21D 39/04 138/142

(Continued)

FOREIGN PATENT DOCUMENTS

DE 39 42 704 6/1991
GB 1128144 A * 9/1968 ..... B22D 11/057

(Continued)

OTHER PUBLICATIONS

International Search Report and Written Opinion dated May 17, 2018, for International Application No. PCT/IB2018/051564, Applicant, EM Moulds S.P.A. A Socio Unico (15 pages).

(Continued)

*Primary Examiner* — Kevin E Yoon
*Assistant Examiner* — Jacky Yuen
(74) *Attorney, Agent, or Firm* — McCracken & Gillen LLC

(57) ABSTRACT

A crystallizer for continuous casting including a tubular body formed of a first and a second tubular element both monolithic each made in one single piece in a metal alloy and mounted coaxial, the first inside the second with radial play, one of the first and second tubular element being provided with one or more grooves opened towards the other tubular element; the first and second tubular element are mechanically coupled together, by plastic deformation by means of drawing between a die and a mandrel appropriately shaped, in such a manner to eliminate the radial play, so that the tubular body is monolithic and the grooves are radially (Continued)

closed, forming conduits in the tubular body configured to serve as cooling conduits and/or housing reinforcement bars.

6 Claims, 4 Drawing Sheets

(52) U.S. Cl.
CPC ..... *B22D 11/057* (2013.01); *B22D 11/059* (2013.01); *B22D 11/22* (2013.01)

(56) References Cited

U.S. PATENT DOCUMENTS

| | | | | |
|---|---|---|---|---|
| 2006/0237161 | A1 | 10/2006 | Roehrig et al. | |
| 2013/0140173 | A1* | 6/2013 | Tierce | H01J 37/342 204/298.12 |
| 2017/0292181 | A1* | 10/2017 | Yano | B22C 9/061 |

FOREIGN PATENT DOCUMENTS

| | | |
|---|---|---|
| JP | H01-60745 | 4/1989 |
| WO | WO 2014/118744 | 8/2014 |
| WO | WO 2014/207729 | 12/2014 |
| WO | WO 2015/059652 | 4/2015 |
| WO | WO 2016/178153 | 11/2016 |

OTHER PUBLICATIONS

Original and translated Notice of Reasons for Rejection for Japanese Patent Application JP 2019-571121, dated Oct. 25, 2021 (9 pages).

* cited by examiner

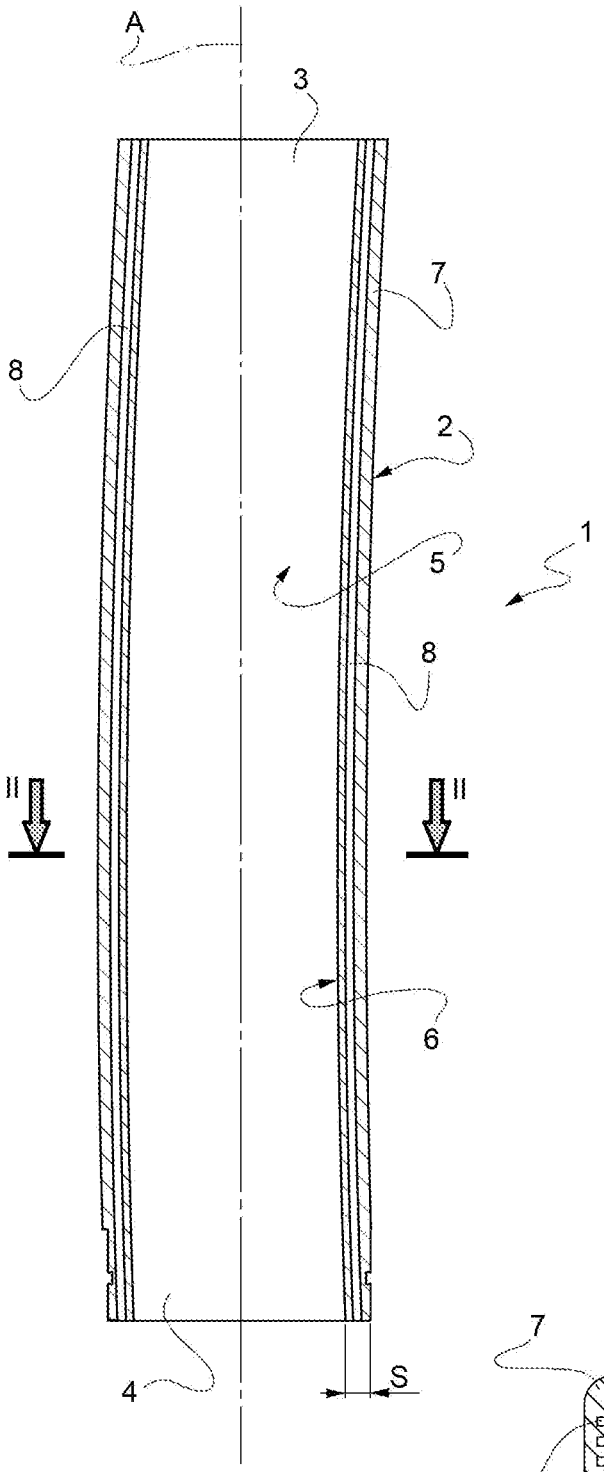
FIG. 1
FIG. 2
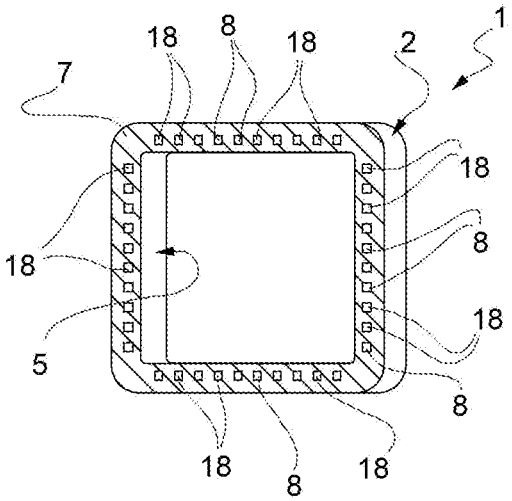

METHOD FOR MANUFACTURING A CRYSTALLIZER FOR CONTINUOUS CASTING

PRIORITY CLAIM

This application claims priority from Italian Patent Application No. 102017000027045 filed on Mar. 10, 2017 the disclosure of which is incorporated by reference.

TECHNICAL FIELD

The present invention refers to a crystallizer for continuous casting, also called "ingot mould", provided with inner conduits for cooling and/or for housing reinforcement elements.

The invention further refers to a rapid and inexpensive method for obtaining said crystallizer for continuous casting provided with inner conduits.

STATE OF THE ART

It is known that in continuous casting plants for steel (and/or other metal alloys) a device is used, known as crystallizer or "ingot mould", consisting of a tubular element with prismatic or circular section, generally with square or rectangular section with rounded corners, having a first end into which the metal alloy in the molten state (or other molten metal material) is fed and having a second end, opposite the first end, from which the metal alloy/metal material flows out still incandescent, but reduced to a substantially solid or semisolid state.

The known crystallizers consist of a tubular body in one single piece made of copper or copper alloy with high copper content and are then mounted inside a jacket in which water or other cooling liquid is made to flow, forming the actual "ingot mould". The molten metal flowing within the crystallizer gradually cools, passing continuously to an at least semi-solid state.

These "monolithic" crystallizers can have various problems during use connected with the uniformity and effectiveness of the cooling and the rigidity of the crystallizer in operation. To reduce or eliminate these problems, cooled crystallizers are provided, in which longitudinal cooling conduits are obtained in the thickness of the lateral wall of the monolithic tubular body, in which water, for example, is circulated. Said cooling conduits consist for example of longitudinal channels made from one end to the other, throughout the length of the tubular body, by means of an appropriate tool. Given the considerable length, said operation is complex and may result in the production of scraps.

A further complication in the construction of crystallizers is the fact that normally they do not have a rectilinear longitudinal development, but follow a bend with a wide radius of curvature, thus presenting a classic banana-shaped longitudinal profile. Substantially, the axis of symmetry of the tubular body that constitutes the crystallizer is curved instead of being straight.

Furthermore, the inner lateral surface in contact with the liquid metal must be shaped so as to gradually reduce the section through which the molten metal passes, thus compensating the shrinkage during the solidification step, i.e. it must have a slight taper; "taper", here and below, means the fact that the inner lateral surface is not parallel to itself, but converges towards the longitudinal axis as it runs from the first to the second end.

Various solutions are therefore known to overcome the drawbacks described. According to WO2014/118744 the crystallizer has on its outer surface longitudinal grooves closed towards the outside by a simple metal layer obtained by electrolytic deposition, after filling of the grooves with a low-melting alloy, which at the end is removed. It is therefore a long and costly process where the adhesion of the outer electrolytic layer is critical.

According to WO2014/207729, the radially outer element of the crystallizer is obtained by binding the radially inner element with a composite material, which is then polymerized. This solution is quicker to produce, but is costly and has the drawback that the outer part of the crystallizer consists of a non-metal material.

According to WO2016/178153, lastly, in order to assemble the radially outer element on the radially inner tubular element (provided with the longitudinal grooves on the outer lateral surface thereof), said radially outer element is produced by the mechanical coupling of two half-shells. In practice the outer tubular element is not monolithic, but divided in a longitudinal direction into two semicircular elements, which are connected by transverse bolts and clamp the inner tubular element, which is monolithic, in the manner of a vice. Also this solution is costly and complex, however, and moreover there is the risk of the cooling liquid leaking out.

One object of the present invention is therefore to provide a crystallizer for continuous casting capable of avoiding undesired deformations and which has a simple and relatively inexpensive construction; in particular one object of the invention is to provide a crystallizer having inner conduits, which at the same time can be produced quickly and in a relatively inexpensive manner, also guaranteeing a high cooling efficiency and high reliability.

A further object of the invention is to provide a method to produce in a quick, simple and relatively inexpensive manner a crystallizer for continuous casting free from the drawbacks of the known art.

SUMMARY OF THE INVENTION

According to the present invention, a crystallizer for continuous casting and a method for producing the same, as defined in the attached claims, are therefore provided.

In particular, the crystallizer comprises a tubular body having a longitudinal axis of symmetry which, in the example illustrated, is not rectilinear but follows a slight curvature (here and below by "slight" curvature we mean a radius of curvature in the order of about ten metres); the tubular body is formed of a first and a second tubular element which are mounted coaxially the first inside the second, as will be seen, with a pre-set radial play, having previously provided either the first tubular element with one or more grooves obtained on an outer lateral surface thereof and radially opened towards the outside, or having previously provided the second tubular element with one or more grooves obtained on an inner lateral surface thereof and radially opened towards the inside; the first and the second tubular element are both monolithic, each being made in one single piece in a metal alloy, and are mechanically coupled together by plastic deformation so that the tubular body is monolithic, an inner lateral surface of the second tubular element being mechanically anchored with continuity to an outer lateral surface of the first tubular element so that the one or more grooves of the first or second tubular element are closed in a fluid-tight manner, to form one or more inner conduits of the tubular body.

The inner conduits thus formed are configured to receive in use a flow of a cooling liquid (water) and/or some or all are configured to receive within it reinforcement bars, made of a material different from the metal material of which the first and second tubular element are made and which are inserted in the one or more grooves and are then blocked during mechanical coupling by plastic deformation between the first and the second tubular element.

The mechanical coupling is obtained by drawing, inserting an appropriately shaped mandrel into the first tubular element and then pushing/pulling both the first and second tubular element through an appropriately shaped fixed annular die.

BRIEF DESCRIPTION OF THE FIGURES

Further characteristics and advantages of the present invention will become clear from the following description of a non-limiting embodiment thereof provided purely by way of example and with reference to the figures of the attached drawings, in which:

FIG. 1 schematically illustrates a longitudinal section view of a crystallizer produced according to the invention;

FIG. 2 schematically illustrates a cross section made according to a plane II-II of the crystallizer of FIG. 1;

DETAILED DISCLOSURE

Figure 3:
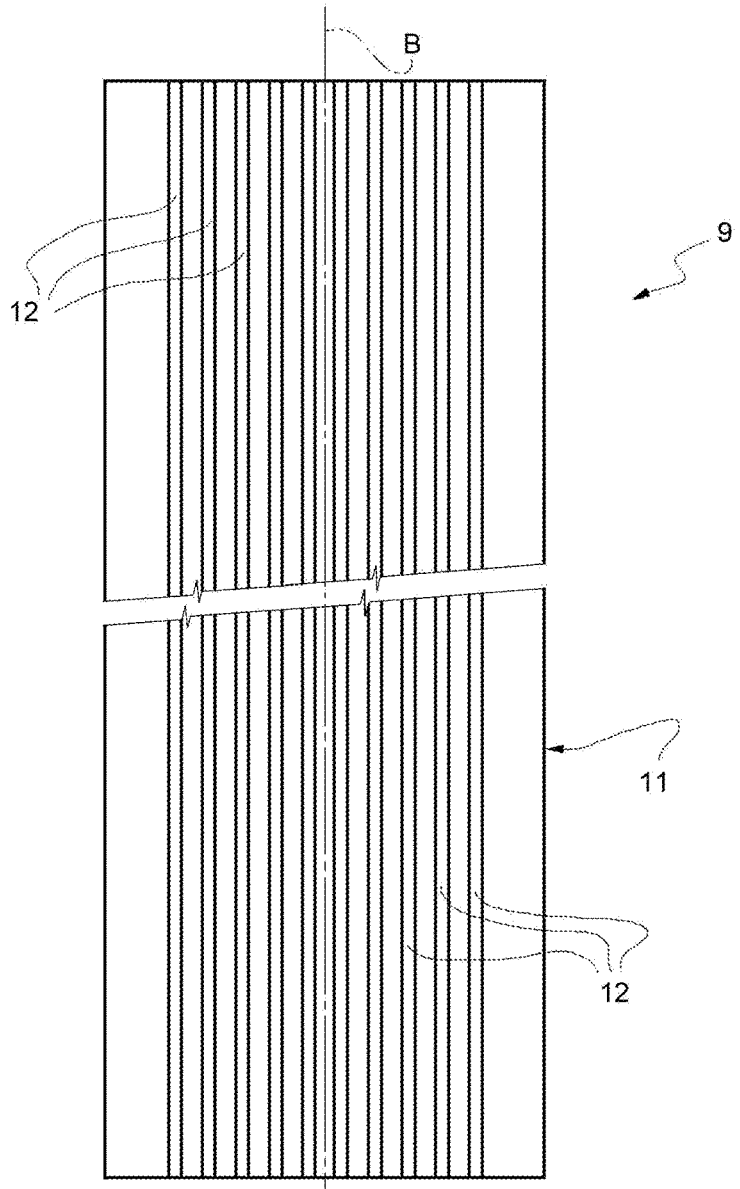
FIGS. 3 and 4 illustrate a longitudinal view and a frontal view of an element composing the crystallizer of FIGS. 1 and 2, and illustrate one of the possible different configurations thereof purely by way of example.
Figure 4:
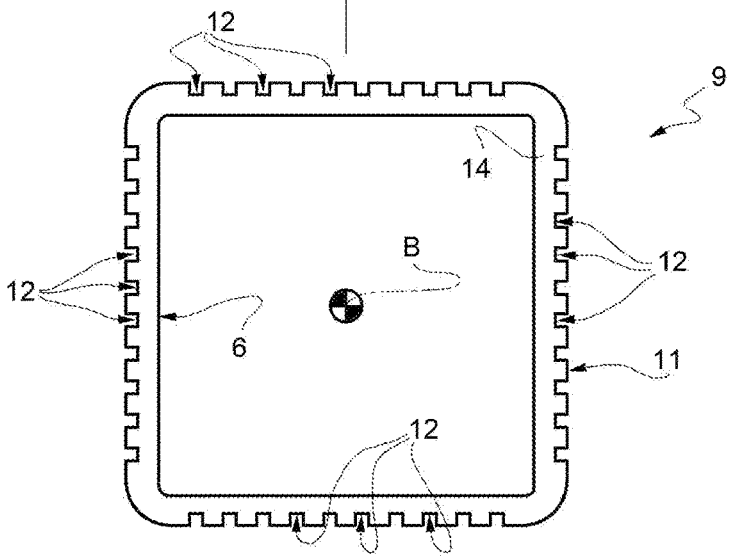

With reference to FIGS. 1 to 6, the number 1 indicates overall a crystallizer configured to carry out continuous casting of a molten metal material, known and not illustrated, for example steel.

The crystallizer 1 comprises a tubular body 2 having a longitudinal axis of symmetry A, in the non-limiting example illustrated slightly curved, and having a first end 3 and a second end 4, both open, the tubular body defining within it, along the axis of symmetry A and between the first and the second ends 3 and 4, a casting cavity 5 having the form of a longitudinal conduit along the axis of symmetry A; the casting cavity 5 is delimited by an inner surface 6 of an annular lateral wall 7 of the tubular body 2, in a radial thickness S thereof, perpendicular to the axis of symmetry A, one or more conduits 8 are obtained; these conduits, according to one aspect of the invention, are configured as will be seen to receive in use in a known manner, which is therefore not illustrated here for the sake of simplicity, a flow of a cooling liquid, for example water, and/or reinforcement bars 18.

The tubular body 2 can have a cross section with circular or prismatic shape, preferably rectangular or square, frequently having rounded edges and, in the example illustrated, has a square cross section.

The tubular body 2, as will be seen better below, is formed (FIGS. 3-6) from a first tubular element 9 and a second tubular element 10 mounted coaxial, the first inside the second; furthermore, in the non-limiting example illustrated, the first tubular element 9 (FIGS. 3 and 4) is provided on an outer lateral surface 11 thereof with one or more grooves radially opened towards the outside. With the tubular elements 9 and 10 coupled to form the tubular body 2, the grooves 12, as will be seen, are closed in a fluid-tight manner towards the outside by an inner lateral surface 13 of the second tubular element 10, to form one or more conduits 8.

In the embodiment example illustrated, a plurality of rectilinear grooves 12, parallel to an axis of symmetry B of the tubular element 9, which is also rectilinear, are obtained on the outer lateral surface 11; the grooves 12 can have a cross section of any shape (semicircular, prismatic, etc.) and can also be not parallel to one another and/or not rectilinear, but have a helical development, for example; the tubular element 9 is defined by an annular lateral wall 14 delimited between the outer lateral surface 11 and an inner lateral surface defining, with tubular elements 9 and 10 coupled, the inner surface 6 of the tubular body 2.

Similarly, the tubular element 10 is also rectilinear and is defined by an annular lateral wall 15 delimited between the inner lateral surface 13 and an outer lateral surface 16 defining, with the tubular elements 9 and 10 coupled, the outer surface of the annular lateral wall 7 of the tubular body 2.

According to a possible variation not illustrated, for the sake of simplicity, the grooves 12 can be obtained on the inner lateral surface 13 and be radially opened towards the inside, and therefore be facing towards the tubular element 9.

According to the invention, the first and the second tubular element 9,10 are both metal and monolithic, in the sense that each one is made in one single piece in a metal alloy, for example by forging and subsequent machining; furthermore, the two tubular elements 9,10 are mechanically coupled together by plastic deformation so that the tubular body 2 not only is formed by the superimposed coupling of the tubular elements 9,10 arranged coaxial, but is also monolithic itself, since the inner lateral surface 13 of the tubular element 10 is mechanically anchored with continuity to the outer lateral surface 11 of the tubular element 9.

According to a non-secondary aspect of the invention, to allow said type of monolithic mechanical coupling, the lateral walls 14, 15 of the first and second tubular element 9, 10 have a first and a second pre-set radial thickness, indicated respectively by S1 and S2, the size of which, measuring the thicknesses S1 and S2 perpendicularly to the axis of symmetry A of the tubular body 2, have a pre-set ratio S2/S1, preferably ranging from 0.75 to 1.2.

The first and the second tubular element 9, 10 are both made in a copper-based metal alloy, containing more than 98% by weight of copper.

According to a possible variation, the first and the second tubular element 9, 10 are made of two different metal alloys, at least one of which is copper-based, containing more than 98% by weight of copper.

In the preferred embodiment example, the tubular element 2 comprises a plurality of conduits 8 which, in the non-limiting example illustrated, are rectilinear and have longitudinal development along the axis of symmetry A; the conduits 8 are defined by the grooves 12, as indifferently obtained either on the tubular element 9 or on the tubular element 10, radially closed by the coupling of the two tubular elements 9, 10.

Furthermore, according to a possible variation of the invention, at least some (or all) of the conduits 8 are occupied by reinforcement bars 18 made of a material, preferably metal, different from that of the first tubular element 9.

Said reinforcement bars 18 also form an integral part of the tubular body 2 in a monolithic manner, since they have been inserted without play in the grooves 12 anywhere obtained and have been subsequently mechanically blocked between the first and the second tubular element 9,10 by plastic deformation.

The conduits 8 according to the invention can therefore serve as cooling conduits if connected in use, in a known manner and not illustrated for the sake of simplicity, to a supply of cooling liquid, for example water, or serve exclusively to house the bars 18, or again to perform both functions.

According to the invention, to produce a crystallizer for continuous casting like the crystallizer 1, a manufacturing method consisting of different steps must be followed to form each monolithic tubular body 2.

In a first step, the first tubular element 9 is made in a first metal material consisting of copper or a copper alloy with a prevalence of copper, forming it rectilinear (for example by forging or by any other machining method) and monolithic in one single piece; the tubular element 9 is made so as to have a first pre-set length and be delimited by a first lateral wall 14 having a first pre-set radial thickness S1.

In a second step, which can be carried out also prior to or during the first step, the second tubular element 10 is made in a second metal material identical to or different from the first metal material, forming it rectilinear (for example by forging or by any other machining method) and monolithic in one single piece; the tubular element 10 is made so as to have a second pre-set length and be delimited by a second lateral wall 15 having a second pre-set radial thickness S2; furthermore, the second tubular element 10 is made so as to be wider than the first tubular element 9.

In a third step, one or more grooves 12 radially opened towards the tubular element 9, 10 which is not provided with the grooves 12 are made by machining on one only of the tubular elements 9, 10, in the example illustrated on an outer lateral surface 11 of the first tubular element 9, or according to a variation not illustrated, on an inner lateral surface 13 of the second tubular element.

Figure 5:
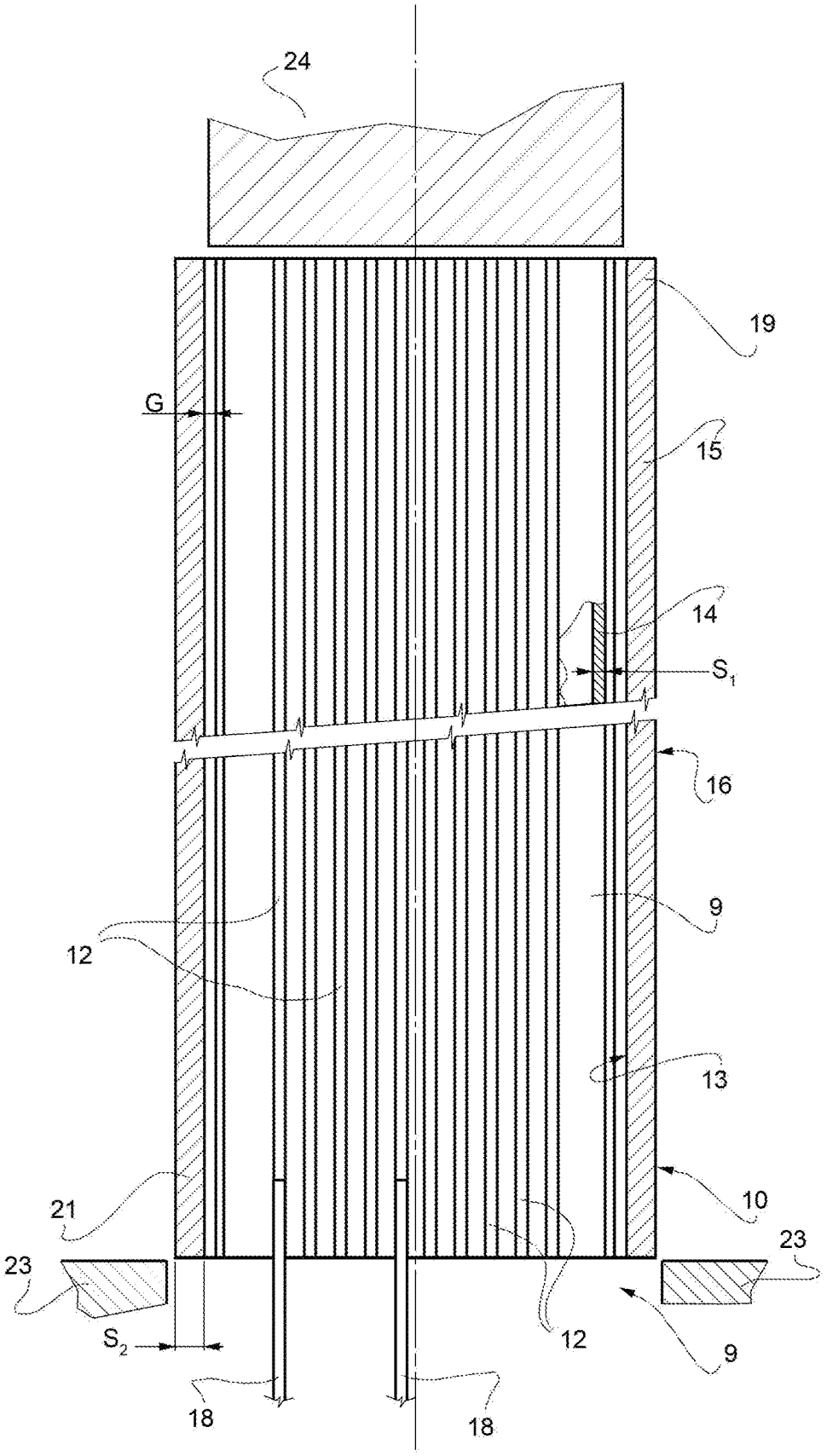
FIG. 5 schematically illustrates, partly in longitudinal section and partly in an external view, an assembly step of a blank which constitutes an intermediate product for the manufacture of the crystallizer of FIGS. 1 and 2.
Figure 6:
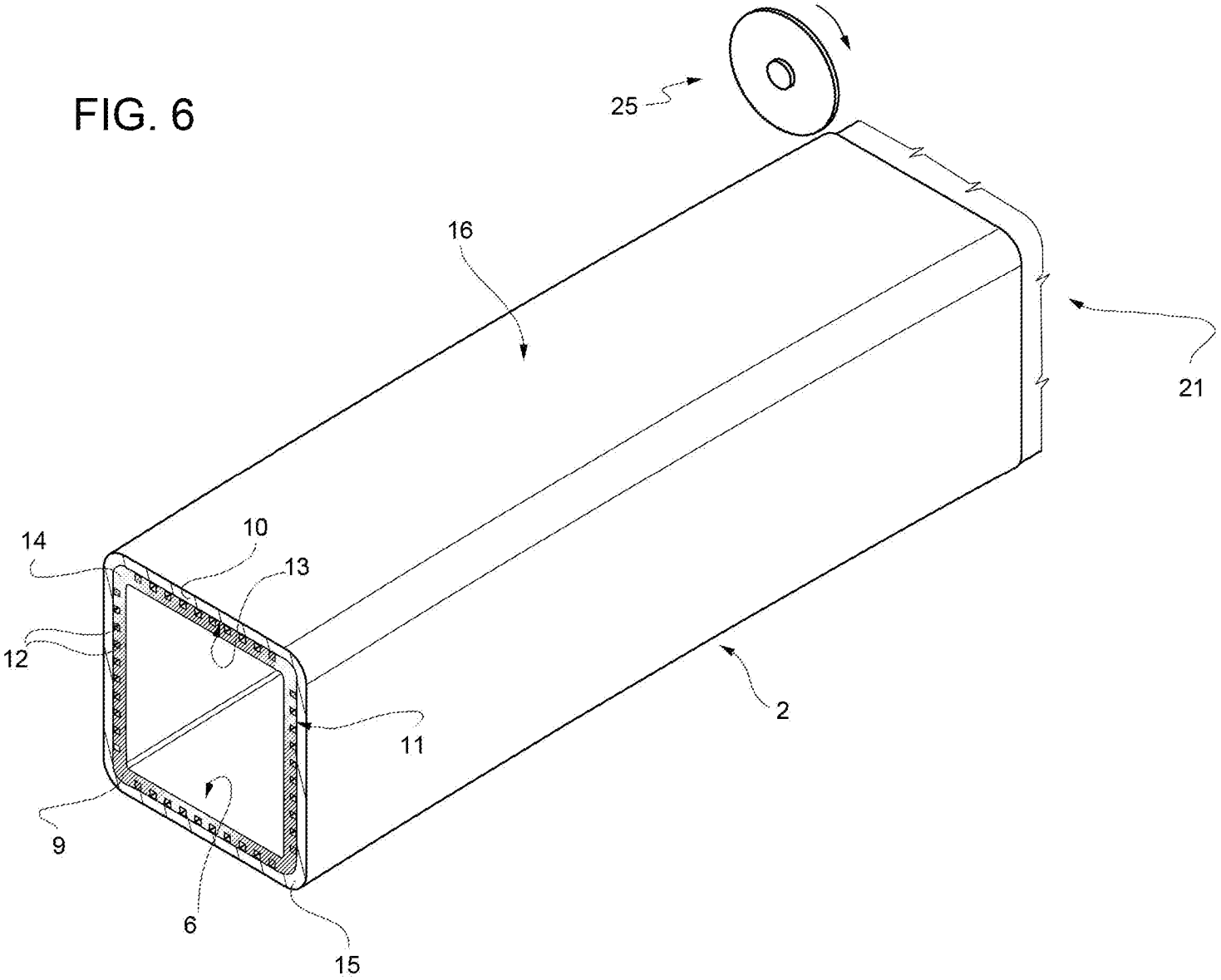
FIG. 6 illustrates a final step of the manufacturing method according to the invention.

In a fourth step, the second tubular element 10 is fitted onto the first tubular element 9, coaxially to the first tubular element 9 and therefore to the axis B, so as to maintain a pre-set radial play G between the first and the second tubular element 9,10 (FIG. 5).

In a fifth step, which must be performed subsequently and in sequence after all the preceding steps, the first and the second tubular element 9, 10 are drawn together, by passing them (FIG. 5) through an annular die 23 and inserting into the first tubular element 9 a mandrel 24 which reproduces in negative the shape that is to be imparted to the casting cavity 5. Then either the first and second tubular element 9,10 are pushed by means of the mandrel 24 through the die 23, which is configured to form the lateral wall 15 of the second tubular element 10 into the shape to be imparted to the tubular body 2, or the mandrel 24 with the tubular elements 9,10 are pulled through the die 23 using an appropriate tool which is known and not illustrated for the sake of simplicity.

This drawing step is performed so that the first and second tubular element 9, 10 are co-extruded through the die 23, pressed between the die 23 and the mandrel 24, and undergo a plastic deformation eliminating the radial play G and forming between them a continuous mechanical coupling which makes them monolithic, so as to create the monolithic tubular body 2 from the two tubular elements 9, 10 initially independent of each other and self-supporting.

The first and second pre-set radial thickness S1 and S2 and the shape of the grooves 12 must be chosen so that during the drawing step the one or more radially opened grooves 12, if the conduits 8 are to be used for the cooling, are not filled with the metal material in the deformation step but are closed radially, so as to form one or more empty conduits 8 in the lateral wall 7 of the tubular body 2 which is created. If the bars 18 have been placed in the grooves 12, the first and second pre-set radial thickness S1 and S2 and the shape of the grooves 12 are chosen so that the metal material during deformation blocks the bars 18 in the grooves 12, making them monolithic with both the tubular elements 9, 10.

To ensure that the drawing step is successful and that during said step the conduits 8 are formed, the ratio between the size of the second and first pre-set radial thickness, S2 and S1, measured perpendicularly to the axis of symmetry, must be appropriately calculated and preferably ranges from 0.75 to 1.2.

Once the drawing step has been completed, a last step is performed (FIG. 6) consisting in cutting away if necessary both respective terminal parts 9 and 21 deformed during the drawing operation by means of a tool 25, obtaining the monolithic tubular body 2.

The first and the second tubular element 9,10, after being obtained and before the drawing step, are appropriately milled to bring them to size and guarantee correct coupling thereof; the ratio between the reduction of the second pre-set thickness S2 at the first end 19 and the pre-set length ranges from 0.1 to 0.2.

The drawing parameters are such as to guarantee correct anchoring to form one single monolothic piece and maintenance of the geometry of the grooves 12.

Lastly, it should be noted that the crystallizer 1 and, consequently, the tubular body 2, have a prevalently arcuate shape, i.e. a banana-shaped longitudinal profile as is well illustrated in FIGS. 1 and 2, so that in said cases the longitudinal axis A is curved. This is obtained by appropriately shaping the mandrel 24 and the die 23. At the same time, during the drawing step, the mandrel 24, which is slightly tapered, imparts a slight taper to the inner surface 6 of the lateral wall 7 while said lateral wall 7 is forming from the intimate coupling of the lateral walls 14,15.

In this way, the stability and reliability of the crystallizer also in the presence of high thermal gradients is guaranteed both by the presence of conduits 8 in which it is possible to circulate a cooling liquid, and equally by the possibility of inserting reinforcement bars 18 in some or all (if it is not necessary to use a cooling liquid) of the inner conduits 8 of the tubular body 2. The reinforcement bars 18 can be made in steel or another alloy or also in composite materials, such as carbon fibre, kevlar, etc.

In both cases, the inner conduits 8 of the tubular body 2 are obtained with precision and in a simple manner to meet many different needs.

The aims of the invention have therefore been fully achieved.

The invention claimed is:

1. A method for manufacturing a crystallizer for continuous casting comprising the following steps:

i)—obtaining a first rectilinear tubular element, which is monolithic in one piece and made of a first metal material constituted of copper or a copper alloy with a prevalence of copper, the first rectilinear tubular element having a first pre-set length, and being delimited by a first lateral wall having a first pre-set radial thickness;

ii)—obtaining a second rectilinear tubular element, which is monolithic in one piece and made of a second metal material identical to or different from the first metal material, the second rectilinear tubular element having a second pre-set length and being delimited by a second lateral wall having a second pre-set radial thickness; the step ii) being carried out so as a)—to obtain the second tubular element wider than the first tubular element, b)—to obtain a ratio between the size of the second radial thickness of the second tubular body and the size of the first radial thickness of the first tubular body ranging between 0.75 and 1.2;

iii)—providing, on an outer lateral surface of the first tubular element or on an inner lateral surface of the second tubular element, one or more radially opened grooves;

iv)—inserting the first tubular element within the second tubular element, so as to couple the first and second tubular element together maintaining between them a pre-set radial play;

v)—co-extruding the first and second tubular elements together by drawing them together through an annular die having previously inserted into the first tubular element a mandrel that reproduces in negative the shape that is to be imparted to a casting cavity of the crystallizer to be obtained and then passing the mandrel with the first and second tubular elements through the die, which is configured for shaping the lateral wall of the second tubular element with a shape that is to be imparted to a tubular body of the crystallizer to be obtained; wherein vi)—during the step v) at least some of the said one or more radially opened grooves are left empty and, owing to the ratio between the size of the second radial thickness and the size of the first radial thickness are not filled by any metal material in consequence of the drawing step, but are instead closed radially, so as that said tubular body of the crystallizer to be obtained is formed as a monolithic body by mechanical coupling in a continuous manner and coaxially to each other the first and second tubular elements together, forming at the same time one or more conduits in the lateral wall of the tubular body.

2. The method according to claim 1, wherein the first and second tubular elements, after being obtained, are milled on the respective lateral walls.

3. The method according to claim 1, wherein before the drawing step, a reinforcing bar is inserted without play in one of the said grooves, the reinforcing bar being made of a material different from that of the first and second tubular elements; during the drawing step said reinforcing bar being blocked in a monolithic way between said first and second tubular elements by plastic deformation.

4. The method of claim 1, wherein the first and second tubular elements are both made of one and the same copper-based metal alloy, containing more than 98 wt % of copper.

5. The method of claim 1, wherein the first and second tubular elements are made of two different metal alloys, at least one of which is copper-based, containing more than 98 wt % of copper.

6. The method of claim 1, wherein one or more of said conduits (8) are configured to receive in use a flow of cooling liquid.

* * * * *